US005697482A

United States Patent [19]

Orus et al.

[11] Patent Number: 5,697,482

[45] Date of Patent: Dec. 16, 1997

[54] GAMES MACHINE WITH ELECTRONIC PAYMENT MECHANISM

[75] Inventors: Hervé Orus, Marseille; Jean-Jacques Foglino, Peynier; Firmin Lopez, Luynes; André Richard, Trets; Alain Nicolai, Allauch, all of France

[73] Assignee: Gemplus Card International, Gemenos, France

[21] Appl. No.: 704,918

[22] Filed: Aug. 30, 1996

Related U.S. Application Data

[63] Continuation of Ser. No. 324,657, Oct. 18, 1994, Pat. No. 5,575,374.

[30] Foreign Application Priority Data

Oct. 18, 1993 [EP] European Pat. Off. ..... 93 402560

[51] Int. Cl.[6] ..... G07F 7/08

[52] U.S. Cl. ..... 194/213; 235/380

[58] Field of Search ..... 194/205, 210, 194/213, 214, 344; 364/412; 235/380; 273/138 A

[56] References Cited

U.S. PATENT DOCUMENTS

| | | | |
|---|---|---|---|
| 4,598,810 | 7/1986 | Shore et al. | 194/205 |
| 4,969,549 | 11/1990 | Eglise | 194/213 X |
| 5,147,021 | 9/1992 | Maruyama et al. | 194/217 |
| 5,179,517 | 1/1993 | Sarbin et al. | 273/435 X |

FOREIGN PATENT DOCUMENTS

| | | | |
|---|---|---|---|
| 0360613 | 3/1990 | European Pat. Off. . | |
| 0480513 | 4/1992 | European Pat. Off. . | |
| 2177835 | 1/1987 | United Kingdom . | |
| 8704831 | 8/1987 | United Kingdom . | |
| 2229845 | 10/1990 | United Kingdom | 194/213 |
| 2243237 | 10/1991 | United Kingdom . | |

*Primary Examiner*—F. J. Bartuska
*Attorney, Agent, or Firm*—Nilles & Nilles, S.C.

[57] ABSTRACT

The disclosure relates to games machines provided with electronic payment mechanisms. The conventional payment mechanism is replaced by a payment mechanism operating by means of tokens that are secured by contract-free detection and the machine is furthermore provided with a second payment mechanism operating by means of a chip card. Switching means make it possible to change over from the token-operated payment mechanism to the chip-card operated payment mechanism when a card such as this is inserted into the corresponding payment mechanism. This device makes it possible to increase the efficiency of the games machines.

13 Claims, 4 Drawing Sheets

GAMES MACHINE WITH ELECTRONIC PAYMENT MECHANISM

This application is a continuation of application Ser. No. 08/324,657, filed Oct. 18, 1994 now U.S. Pat. No. 5,575, 374.

BACKGROUND OF THE INVENTION

1. Field of the Invention

The present invention relates to games machines provided with a payment mechanism, notably an electronic mechanism, that makes it possible to use different systems of payment that are both more secure and more practical than those presently in existence.

2. Description of the Prior Art

It is the practice, especially in casinos, to use games machines similar to those shown schematically in FIG. 1. These machines generally take the form of a body 101, provided with a window 102 used to display the parameters of the game. The machine may have a side arm 103 used to start the game which consists, for example, of the scrolling of symbols on the screen. In this example, the game is won if the symbols form a winning combination; if not, it is lost.

To start play, the player must put one or more counters or tokens 105 into a payment mechanism 104. When the game is won, a feeder box 106 releases a certain number of tokens corresponding, according to the rules of the game, for example to n times the amount wagered.

At present, the tokens are most usually metal tokens which may have different colors and diameters corresponding to different face values. They may also be made of materials of different natures. In order to enable the payment mechanism 104 to distinguish between the different tokens, it then becomes necessary to make use of the magnetic signature given by the materials of different natures and/or to make use of the different dimensions. Another practice still in use is the old one of using coins instead of tokens.

In addition to possible attempts at fraud, the use of tokens is not practical. It requires the presence of a relatively large staff in a central cashier's office, and the carrying out of accounting operations that give rise to errors and are even a source of fraud. Furthermore, the use of the tokens slows down the use of the machine and restricts the possible amounts that can be wagered.

It is therefore sought to be able to replace the use of tokens by a more modern system without, however, completely giving up this practice so as to avoid upsetting players' habits and so as to retain certain user-friendly aspects of the machine.

SUMMARY OF THE INVENTION

For this purpose, the invention proposes a games machine with an electronic payment mechanism chiefly comprising a first payment mechanism using tokens that are secured by contact-free detection, and/or a second chip-card payment mechanism that is then associated with switching means for the use, by choice, of either one of these two payment mechanisms.

BRIEF DESCRIPTION OF THE DRAWINGS

Other features and advantages of the invention shall appear clearly from the following description, made by way of a non-restrictive example, with reference to the appended figures of which.

MORE DETAILED DESCRIPTION

Figure 1:
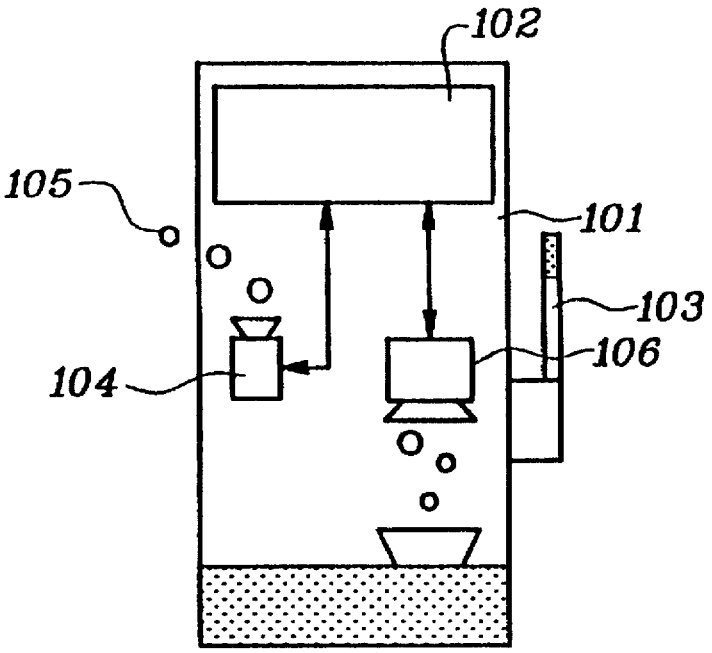
FIG.1 PRIOR ART
FIG. 1 shows a prior art games machine.
Figure 2:
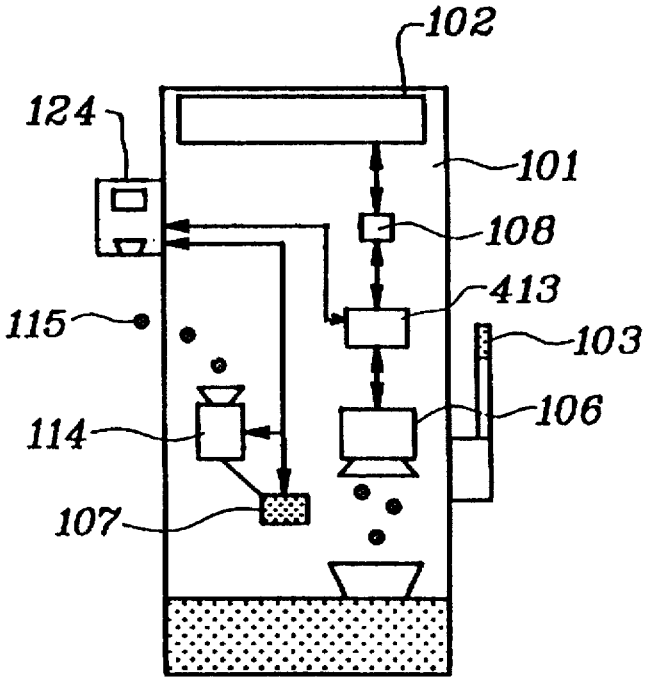
FIG. 2 shows a games machine according to the invention.

The games machine according to the invention shown in FIG. 2 is essentially identical in its appearance and operation to the standard machine shown in FIG. 1. Indeed, it is very important not to disturb the player's habits.

According to the invention, the payment mechanism 104 is replaced by a payment mechanism 114 that has an identical external appearance but works with tokens 115 secured by an electronic device and, if necessary, a second payment mechanism 124 is added enabling the machine to work also with a chip card or smart card. The payment mechanism 124 will preferably be fixed to the right-hand side of the machine at an appropriate height so that the chip card can easily be inserted into the slot of the payment mechanism and so that it is possible to read the indications on the display device with which the payment mechanism is provided, this display device being used to indicate different items of information, notably the balance in the card. The payment mechanism 124 may also be integrated into the machine.

So-called chip cards or smart cards are well known in the prior art and are used, for example, in telephone booths or in cash dispenser machines.

The chip card used in the games machine according to the invention will preferably have an external appearance and an internal electrical circuitry similar to those presently standardized, such as the prepayment or rechargeable cards available in the market, which can be used in particular, under the control of the reader, to totalize the winnings from games won. It is possible, however, to plan for the use of any appropriate type of card, especially the cards presently designed to play the role of an electronic wallet, these cards being particularly designed so that they can be refilled in an appropriate reader. It is even possible, as the case may be, to use a bank type card by providing for the payment of the winnings, if any, by means of an appropriate procedure, for example by the distribution of tokens or by payment at the central cashier's office. The latter mode of payment will be all the more conceivable as the bank card will preferably be used for relatively big wagers warranting its use.

The payment mechanism 114 has a mechanical part that can be used to receive the tokens 115 and make them file past a reception antenna providing for an interface With these tokens which are provided with an integrated circuit enabling them to be identified in a secured way and enabling their value to be determined.

Figure 3:
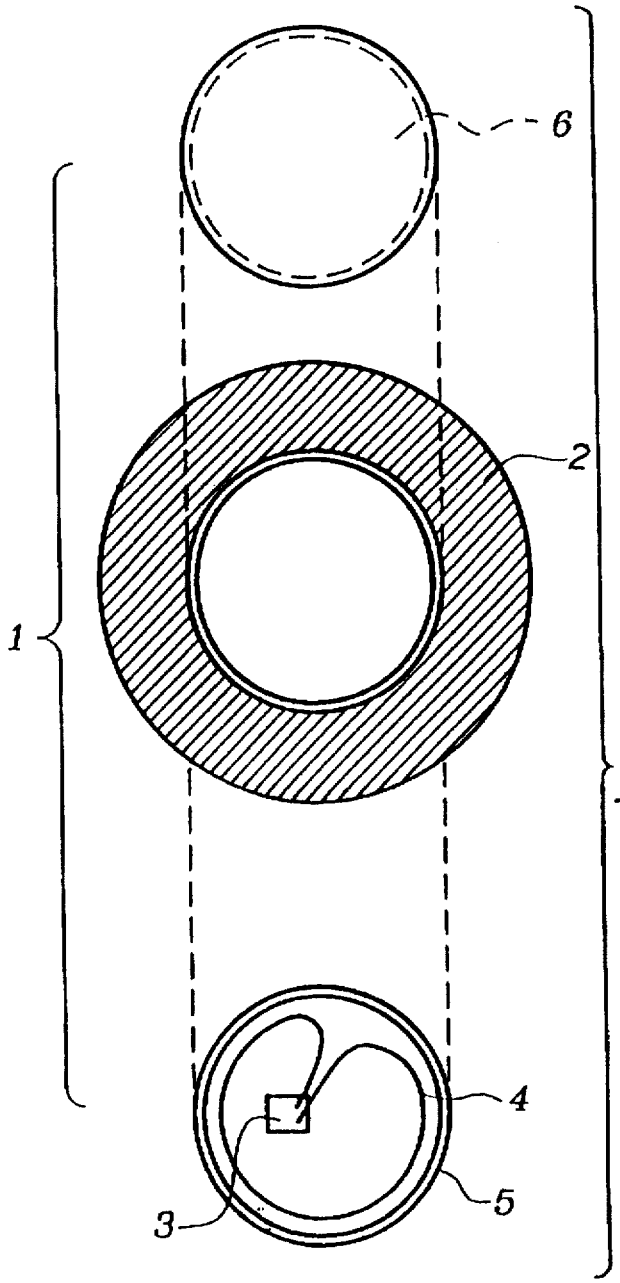
FIG. 3 shows a longitudinal section of a secured token and FIG. 3A shows an alternative preferred antenna for the secured token.
Figure 4:
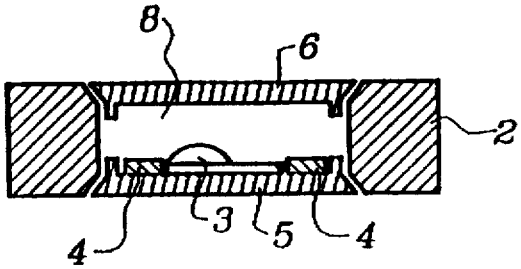
FIG. 4 shows a cross-section of a token such as this.

The drawings of FIGS. 3 and 4 may be referred to for the rest of the description of these tokens.

An electronic token 1 such as this carries an information element that can be read automatically. The use of such a token will be sought in order to combat fraudulent behavior involving the imitation of the tokens in the use of coin-operated machines or any other machine using tokens or coins. Reference shall be made hereinafter to tokens,. it being understood that these could be tokens or coins depending on the application.

The electronic token 1 which is an object of the invention is constituted by a set of elements 2, 5, 6 assembled so as to provide mechanical strength to the token and so as to ensure the physical protection of the electronic circuit 3 and 4 placed in the token.

This electronic circuit enables the identification of the token, i.e. it carries a characteristic information element that can be controlled so as to check the authenticity of the token.

The electronic circuit enabling the identification of the token has an integrated circuit 3 for the storage of the characteristic information and transmitter/receiver type means 4 enabling contact-free access to this information.

Figure 3A:
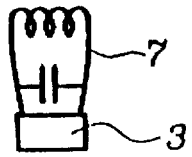

The means of contact-free access to the characteristic information comprise, according to a preferred embodiment, an antenna constituted by a simple coil 4 or, according to another embodiment illustrated in FIG. 3A, by an oscillating circuit 7. In the case of an oscillating circuit, it will be possible to gain access to the characteristic information at a fair distance (of about ten centimeters) while in the case of a simple coil, this distance will be far smaller (some millimeters) since the frequency tuning is "loose" with the inductance coil alone. The simple coil is used, for example, for coin-operated machines in which the token may be guided precisely in the vicinity of a means for the contact-free reading of the token.

The reading is done by a contact-free reader (not shown) capable of sending out an amplitude-modulated magnetic field. The integrated circuit of the token uses this modulated magnetic field to get its supply. The response of the token is made by modulation of the magnetic field by the antenna of the token as a function of the characteristic information elements stored in this token.

The storage means placed in each token comprise a PROM containing a series number programmed during its manufacture. It is possible, for example, to choose a PROM with laser programming.

The characteristic information therefore comprises a series number. It may also include the face value of the token or an encoded information element.

More specially, the token is constituted by a metal ring 2 and two side-plates 5 and 6 that are concentric with the ring and are placed on either side of this ring. One of the two side-plates is used as a support for the electronic circuit. The circuit may, for example, be fixed to this side-plate by bonding. The circuit is then between the two attached side-plates. The internal space is filled with resin 8.

The token may be manufactured as follows, in accordance with another aspect of the invention.

The side-plates are made of plastic and the ring is made of metal. This makes it possible to have not only mechanical strength but also a jingling sound similar to that of coins.

The procedure is carried out in the following steps:

metal plates are cut out to obtain rings of a desired dimension.

The side-plates are made by thermoplastic injection. The material used is resistant to shocks and abrasion. Polycarbonate, polysulfone, polytherimide, possibly charged with fiberglass, could be used for example.

The use of a thermoplastic enables different colors to be obtained. The colored tokens could be used for the coin-operated machines.

A logo or markings could, if necessary, be engraved in the mold.

The integrated circuit and the antenna may, if necessary, be fixed to an epoxy glass substrate.

A side-plate 5 is then positioned. This side-plate may have a housing reserved for the insertion of the electronic circuit.

It is possible to provide for the deposition of a drop of bonder on the side-plate for the attachment thereto of the integrated circuit and the antenna formed by the coil 4 or the oscillating circuit 7.

A drop of resin is then deposited on the integrated circuit and on the antenna.

The metal ring 2 is positioned.

The second side-plate 6 is positioned.

The assembly is fixedly joined together by ultrasonic soldering, or by being clipped together or bonded.

Finally, the token is tested before being put on the market.

As can be seen in FIG. 2, the mechanical part of the payment machine 114 is connected to an electronic device 107 that makes it possible both to control the motors of the mechanical part and to interface with the tokens. This electronic device is connected to the card-operated payment mechanism 124 so that the player can use either one of these payment mechanisms. The payment mechanism working by default will preferably be the token-operated payment mechanism and the switching to the card-operated payment mechanism will be done by the insertion of the card into this machine. The card-operated payment mechanism is itself connected to the electronic means 108 of the games machine and the electronic circuits of the card-operated payment mechanisms are designed to interface with the standard interface of these electronic means 108.

Figure 5:
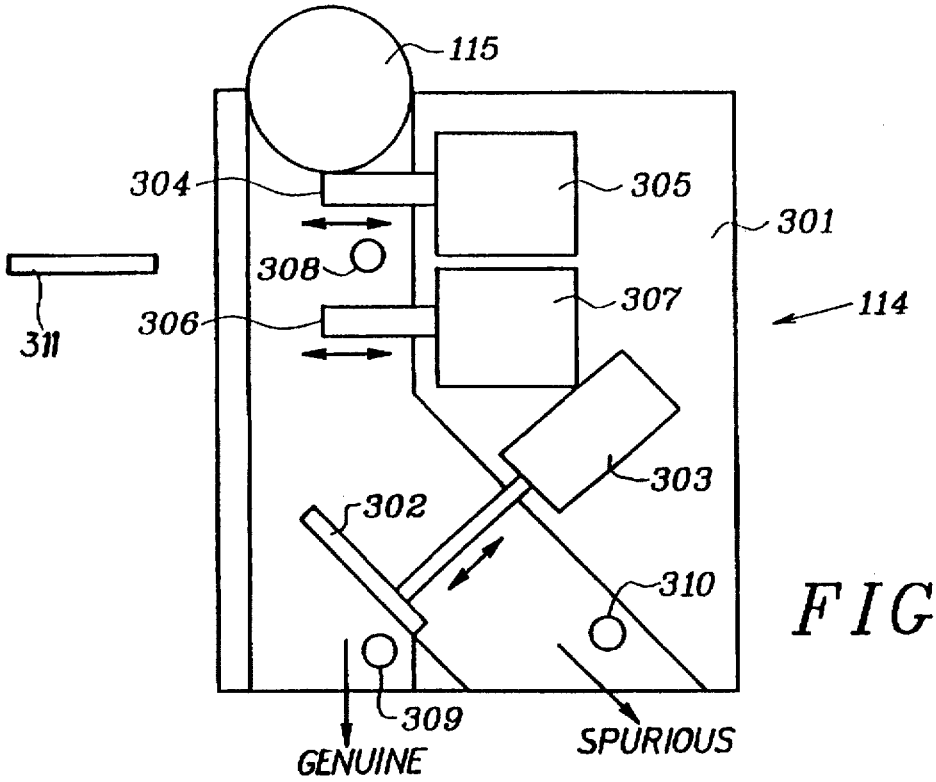
FIG. 5 shows a payment mechanism using secured tokens.

FIG. 5 shows the mechanical part 114 of the token-operated payment mechanism.

The problem raised by the use of a secured token of the type described according to the invention is that it is necessary to have the time to carry out a contact-free transaction between the token and the remote control needs of this token while the token goes into the payment mechanism, especially while it is passing between the means that enable it to be oriented towards one of the two outlets corresponding to tokens recognized as being genuine ones or spurious ones. Indeed, given the size of the payment mechanism, which preferably should be very similar or even identical to that of a conventional payment mechanism, the path of the token is very short and the duration corresponding to this path is very small and just enough to allow an accurate transaction enabling the validity of the token to be recognized.

In order to enable this transaction to be carried out with sufficient security, the invention proposes, for example, that the token be held still for the necessary amount of time by means of the means shown in FIG. 5.

The payment mechanism seen in a sectional view in FIG. 5 comprises a body 301 provided with a slot at its upper end into which a token 115 is inserted.

This slot opens into a tunnel that bifurcates into two separate directions: one vertical "genuine token" direction that directs the token into the games machine where it is stored; one inclined "spurious token" direction that directs the token towards an outlet slot enabling the player to retrieve it.

The orientation of the token between these two outlets is obtained by means of an inclined arm 302 which can be retracted by the action of an electromagnet 303 so as to get placed flat against the wall of the passageway opening into the outlet for spurious tokens. When the arm is in its resting position corresponding to the unretracted position, the token is directed towards the outlet for spurious tokens outlet and when it is retracted against the wall of the passageway, the token falls into the outlet for genuine tokens.

Furthermore, in the vertical part of the passageway, before its bifurcation, there is a first finger 304 that can be used to block this passageway while the token 115 is half inserted into the inlet slot and a second finger 306 that makes it possible to block it when the token has crossed the obstacle corresponding to the first finger. These fingers are manipulated respectively by electromagnets 305 and 307.

Finally, there are three presence detectors, of the optical or magnetic type for example. A first detector 308 is located against the fingers 304 and 306, a second detector 309 is located before the outlet for genuine tokens and a third detector 310 is placed before the outlet for spurious tokens. Naturally, the contact-free reading antenna 311 must be placed close to the reader 308.

These electromagnets are controlled by electronic means 107 which themselves receive the detection signals from the detection means 308 to 310. The operating program of the token-operated payment mechanism is used to control the electromagnets as follows:

when the games machine is not in operation, none of the electromagnets is supplied and, .in this idle position, the fingers 304 and 306 are retracted leaving free passage to the token 115 and the arm 302 is positioned in the middle of the passageways orienting the token towards the outlet for spurious tokens.

When the system is in operation waiting for a token, the finger 304 is retracted, the finger 306 is out and the arm is in position. It is thus possible to insert a token 115 which crosses the position of the finger 304 and remains blocked by the finger 306 facing the detection means 308. The remote-control means of the token are also located at this level.

The detection of the token by the detector 308 causes the finger 304 to come out. This-finger 304 blocks another token which might have been inserted after the first one. The transaction between the token and the means that check it then takes place without any problem since the token is held still by the finger 306 in a position where these checking means can work easily.

When the test is over, if the token is recognized as a genuine token, the arm 302 and the finger 306 are retracted simultaneously, thus enabling the token to go through the outlet for genuine tokens. This passing by the outlet for genuine tokens is detected by the detector 309 and following this detection, the finger 306 and the arm 302 come out into the passageways. Then, the finger 304 gets retracted to enable the arrival of a new token. The detector 309 is used to ascertain that the token has not remained jammed in the reader. If this is the case, the signal from the detector enable the activation, for example, of an alarm (not shown).

If the detection indicates that the token is spurious, only the finger 306 gets retracted while the arm 302 remains in position. The token then comes out by the outlet for spurious tokens. The detector 310 detects its passage and the finger 306 comes out into the passageway. Then the finger 304 gets retracted enabling also the arrival of a new token. The detector 310 has the same function as the detector 309 and may consequently activate an alarm when a token is jammed.

The cycle can then start again.

Figure 6:
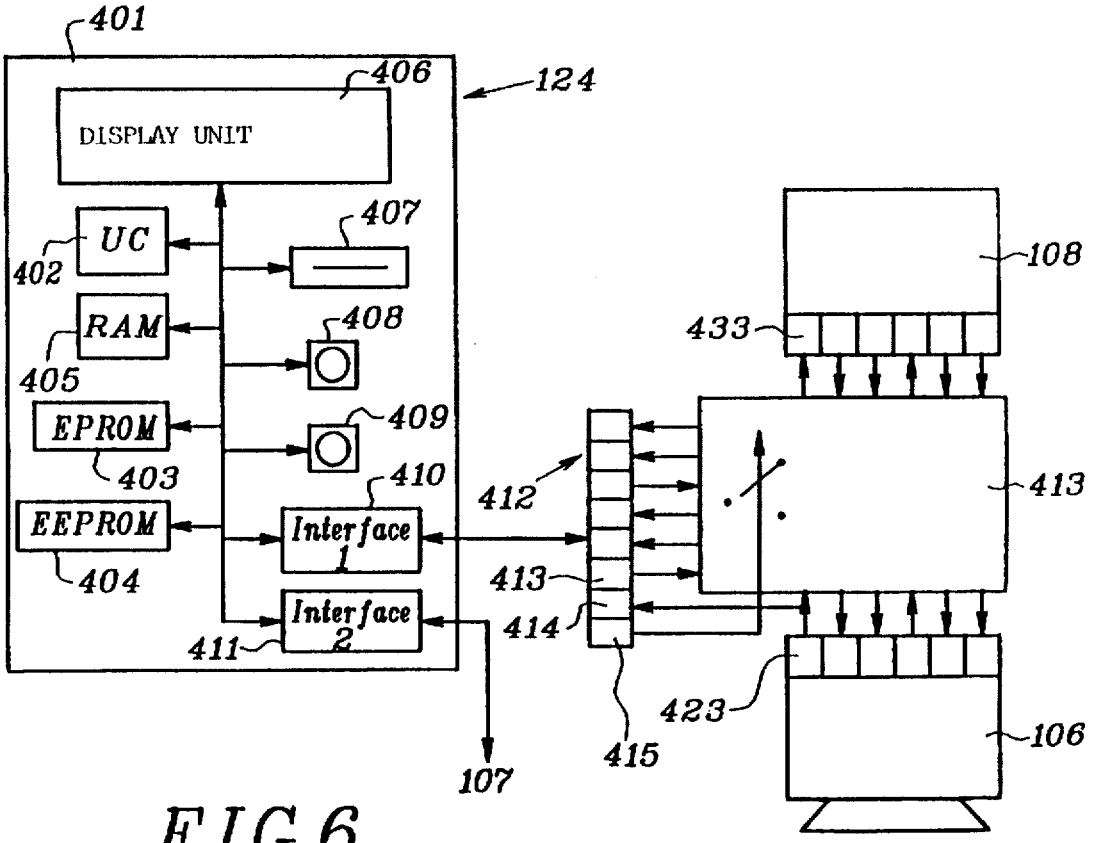
FIG. 6 shows a chip-card payment mechanism.

The card-operated payment mechanism 124, a simplified drawing of which is shown in FIG. 6, has, per se, a structure that is very close to that of the well-known chip-card readers.

This payment mechanism comprises, within a pack 401, essentially a microcontroller 402 which manages all the operations. This microcontroller is joined by a bus to a program memory 403, which is an EPROM type memory for example, to a second memory 404, which is of the EEPROM type for example, enabling the storage of a certain number of parameters that undergo little change, these parameters being prohibition lists for example, and to a third RAM type memory 405 acting as a random-access memory for the performance of the program of the microcontroller. The microcontroller may possibly be connected to an RTC (Real Time Clock) circuit and to a security module comprising a DES or RSA diversification algorithm.

The bus is also connected to a display unit 406 that enables the display in particular of the sums wagered and the winnings obtained, to a chip-card reader 407 designed to receive the player's card and, possibly, cards intended for staff members to take action, for example, on the parameters of the payment system (notably the value associated with the minimum and maximum buttons), and to a certain number of control buttons, in this case two buttons 408 and 409. In this exemplary embodiment, these buttons are used by the players to place their wagers, the first button corresponding, for example, to the minim wager and the second to the maximum wager. Another button (not shown) is used to start the game. Finally, in the payment mechanism, there are a certain number of interfaces designed to connect it with the exterior. In this exemplary embodiment, there is a first interface 410 designed to connect it to the games machine and a second interface 411 designed to connect it to the electronic means 107 of the token-operated payment mechanism.

The interface 410 enables the decoding of the instructions that appear on the bus and are intended for the games machine. The physical interface designed to be connected to the games machine takes the form of a connector 412 comprising a set of pins enabling the transmission and reception of the same signals as those that travel between the electronic means 108 of the games machine, the distribution feeder box 106 and the mechanical payment mechanism which is herein replaced by the electronic token-operated payment mechanism 114.

The signals that appear at this connector 412 will be determined by instructions flowing on the bus of the payment mechanism 124 and decoded by the interface 410. These instructions will themselves be determined by the operating program implanted in the memory 403. The program and the interface comprising the connector 412 are suited to the types of machines used. In the exemplary embodiment described, the machine meets the specifications of existing machines currently available in the market.

The connector 412 is connected to a switching device 413 that enables the connection of the electronic means 108 either to the payment mechanism 124 or to the feeder box 106 while nevertheless retaining the connections with the payment mechanism that are necessary for the operation of the payment mechanism 144 using secured tokens as well as, if necessary, a supervision connection.

Thus, when the player uses the card-operated payment mechanism 124 by inserting a card into its slot, this payment mechanism takes control and causes the connection means 413 to get switched over in such a way that the signals that are sent to the distribution feeder box 106, in order to make it deliver if necessary the tokens coming from a winning game, are sent towards the interface 410 in order that the microprocessor 402 may recognize the amount of the winnings and bring about a corresponding incrementation of the memory contained in the card inserted into the reader 407. Simultaneously, the microprocessor makes a display, on the display unit 406, of the indications corresponding to these winnings. For example it displays the total amount of credit available in the card after this operation. Furthermore, the microprocessor controls the transmission, by the interface, of signals to the electronic means 108 which simulate the delivery, by the feeder box 106, of the tokens. Indeed, this microprocessor normally sends out a signal for each token that emerges so as to enable the electronic means 108 to count out the tokens thus delivered by the feeder box. This signal is delivered to the terminal 413 of the connector 412 and it corresponds to the signal sent by the terminal 423 of the feeder box 106 and received at the terminal 433 of the connector of the electronic means 108. As a variant, the invention proposes the reception, at a terminal 414 of the connector 412, of the signals sent out by the terminal 423 when it is the feeder box itself that works, namely when the player uses the token-operated payment mechanism 114. This enables the storage, in a working memory of the card-operated payment mechanism 124, of the winnings corresponding to the operation with the tokens.

To enable the switching over of the switching means 413 between the feeder box 106 and the card-operated payment mechanism, the connector 412 further has an additional terminal 415 from which there emerges the control signal of these switching means 413.

For example, the games machine could work as follows.

When the player uses tokens, he inserts them into the payment mechanism 144 and the machine works in the usual way except that the tokens are verified with far greater certainty and that the electronic means of the card-operated payment mechanism 124 records the tokens delivered by the feeder box 106 in the event of winnings, thus enabling statistics to be obtained on these winnings.

When a player wishes to use the payment mechanism 124, he inserts his card into the reader 407. This insertion activates the operation of this payment mechanism which activates the switching of the switching means 413 and takes control over the input the stakes and the output of the winnings. The contents of the card 407 are then checked in order to validate its existence and the amount of the credits recorded therein. This validation makes it possible, for example, to eliminate counterfeit cards or cards belonging to individuals entered in a black list of barred players'. The validation will be done by means of security recognition methods well known to those skilled in the art.

When these checks have been carried out and recognized to be valid, the microprocessor will make a display, on the display unit 406, of the amount of the credit contained in the card. The player will choose the amount of his wager by pressing one of the two buttons 408 or 409. For intermediate wagers between the minimum wager and the maximum wager, the player could press the button 408 several times until he reaches the maximum wager. Certain machines will prohibit maximum wagers by means of an inhibition signal sent out by the machine. This action will be conveyed to the display unit in several ways, for example by the display of the wager or the decremented amount of credit registered in the card, or both elements successively or simultaneously.

The player will then make the games machine work in a conventional way, for example by activating the lever 103.

In the event of loss, nothing happens and the payment mechanism resumes control, for example by again displaying the amount Of credit in the card. The player can then start another wager by pressing the buttons 408 or 409. It can be seen that it is thus possible to accelerate the working of the games machine as compared with the situation where the tokens have to be fetched and put into the payment mechanism 144. Thus the profitability of the machine is greatly improved.

Should the player win, the amount of his winnings is transmitted to the games machine 124 and the microprocessor credits the card with this value. Simultaneously, the winnings obtained and/or the amount of the new credit is displayed on the display unit 406 and the player can play once again and as quickly as in the previous cases without having to recover the tokens which are redistributed by the feeder box 106.

The different transactions used by the players' cards as well as a certain number of information elements relating to the game with the tokens, inter alia the amounts distributed following a winning as explained further above, are memorized in the memories 404 of the card-operated payment mechanism 124. This makes it possible, at different times, for example at the end of a day, to collect these information elements for purposes of checking and obtaining statistics. For this purpose, it is possible for example to use an additional interface, for example an RS232 serial line or an infrared system provided with an appropriate connector placed in the payment mechanism 124. Another approach consists in the use of a specific card, for example the card known as the MaxiCard (mark registered by the present Applicant), by the manager of the games machine. This card is introduced into the reader 407 which recognizes it and implements the program for the loading, into the card, of the data elements collected in the memories of the payment mechanism.

The face values of the tokens are generally determined by their color. They have to be sorted out according to these values at different steps in their use, for example within the games machine or at the central cashier's desk where they are distributed. The system of tokens secured by remote detection according to the invention enables this sorting-out process to be made considerably easier.

Figure 7:
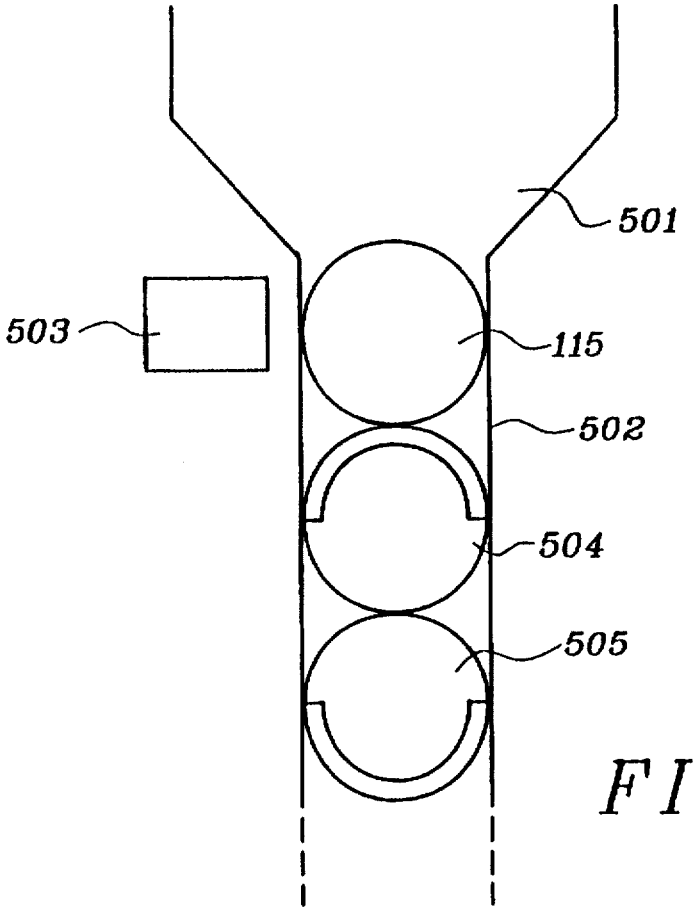
FIGS. 7 and 8 show front and side views of a device for the sorting out of secured tokens.
Figure 8:
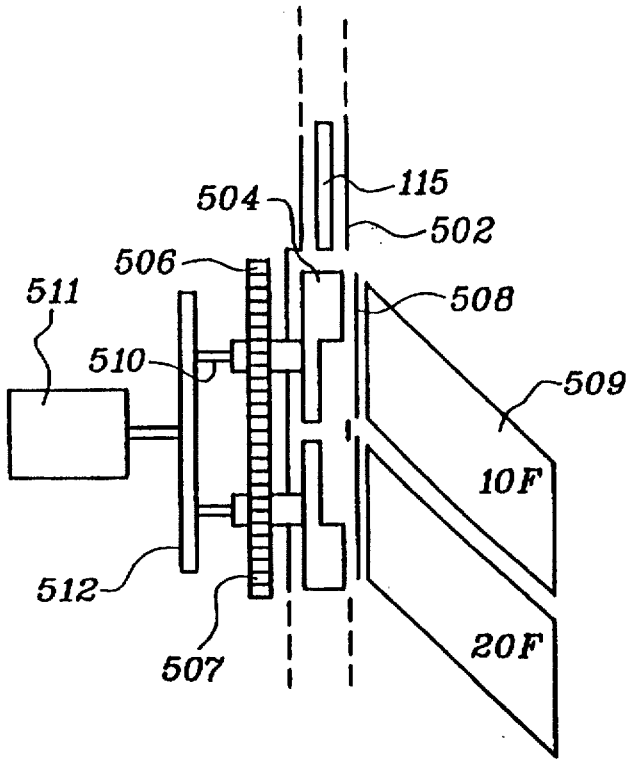

To this end, the invention uses a machine represented schematically in FIGS. 7 and 8 in front and side sectional views.

The tokens which have been placed loose in a feeder box 501 reach a sorting channel 502 where they are held still in a first position represented by the token 115, before a remote detection system 503 that can be used first of all to ascertain that the token is a genuine token and then to find out its value. In this position, the token is held still on a roller wheel 504 having a half-ring positioned on its circumference to demarcate an internal hollow having the size of the token. In this position, this half-ring is in the upward position, thus stopping the token. When the token is recognized as being a genuine one and when its value has been memorized, the roller 504 driven by a motor, not shown, starts rotating, and when it has made half a rotation, the token falls into the internal hollow of the roller.

Beneath the roller 504, there is a second roller 505 identical to the first one. These rollers are driven, for example, by a system of toothed wheels 506 and 507 in such a way that their rotational speeds are identical but that the rings are located opposite to each other. Thus, at the next semi-rotation, the token which is in the internal hollow of the roller 504 falls into the internal hollow of the roller 505. Although the figure shows only two rollers, the machine has as many rollers as there are face values of the tokens. It is also possible to provide for the positioning of an additional number of rollers so as to provide for a changing of the face values of the tokens.

In this way, for each rotation of all the rollers, the token goes from one roller to the next one during one semi-rotation and then stops during one semi-rotation.

When the token is blocked in a roller corresponding to its face value, an electronic system (not shown) connected to the detection means 503 opens a hatch such as 508 facing the roller thus selected. The token then falls into a sorting chute 509 at whose outlet it gets stacked on the other already-stored tokens having the same value. If necessary, a piston 510 that goes through the shaft of the roller, pushes the token towards the chute 509 under the effect of an electromagnet 511. This makes it possible to release the token with greater certainty although it is possible, by an appropriate arrangement of the device, to use only the effect of gravity.

It is seen that the device, at any time, knows the location, in each of the successive rollers of the sequence of rollers, of the tokens sorted out at the first level. In this way, the tokens can succeed one another continuously, one after the other, in the rollers and it is enough to open the right hatch at the right time. Similarly, a single electromagnet 511 can be used to press on all the pistons 510 by means of the common bar 512. The link between this bar and the pistons is obtained by a means of system using telescopic springs in such a way that if a hatch is not open the piston gets retracted in compressing the spring.

There is thus a particularly simple sorting device since only one motor suffices to drive all the rollers and only one electromagnet suffices to drive all the pistons.

What is claimed is:

1. An electronic payment mechanism for a games machine comprising a first token payment mechanism operated by tokens secured by contact-free detection, a second chip-card payment mechanism, and switching means for automatically switching between the first and second payment mechanisms, the switching means accepting payment from the first token payment mechanism when a chip card is not inserted into the second chip-card payment mechanism, and, wherever a chip card is inserted into the second chip-card payment mechanism, the switching means switching over automatically to the second chip-card payment mechanism thereby no longer accepting payment from the first token payment mechanism for so long as a chip card is inserted in the chip-card payment mechanism.

2. A payment mechanism according to claim 1, wherein the first token payment mechanism includes means for holding a token fixed in a position thereby enabling a transaction with a token recognition means for the period of time needed for performing the transaction.

3. A payment mechanism according to claim 1, wherein the second chip-card payment mechanism includes an interface defining means for transmitting and receiving signals identical to signals transmitted and received by a mechanical payment mechanism.

4. A payment mechanism according to claim 3, further comprising a means for counting the distribution, by a feeder box, of tokens won and for memorizing a total number of tokens won during the operation of the games machine with tokens.

5. A payment mechanism according to claim 4, comprising an output terminal enabling the delivery of signals to means for controlling the switching over between the first payment mechanism and the second payment mechanism.

6. A method of receiving payment at a games machine comprising the steps of:

providing the games machine with a token payment mechanism;

providing the games machine with a chip card payment mechanism;

ascertaining whether a chip card is inserted into the chip card payment mechanism, and wherever the chip card is inserted into the chip card payment mechanism, then accepting payment only from the chip card for so long as a chip card is inserted in the chip card payment mechanism;

and if the chip card is not inserted into the chip card payment mechanism, then accepting payment only from tokens;

and wherein the ascertaining step is performed by the games machine.

7. A method according to claim 6, wherein during the ascertaining step the games machine ascertains that the chip card has been inserted into the chip card payment mechanism, and further comprising the step of emulating a mechanical payment mechanism, the emulating step being performed by the chip card payment mechanism, and wherein the emulating step includes the steps of transmitting and receiving electrical signals which are of a same format as signals transmitted and received by the mechanical payment mechanism.

8. A method according to claim 6, wherein during the ascertaining step the games machine ascertains that the chip card has not been inserted into the chip card payment mechanism, and further comprising the steps of inserting a token into the token payment mechanism;

holding the token in a position adjacent a token recognition device;

interrogating the token while the token is held adjacent the token recognition device.

9. A method according to claim 6, wherein during the ascertaining step the games machine ascertains that the chip card has not been inserted into the chip card payment mechanism, and further comprising the steps of counting a number of tokens distributed by a feeder box of the games machine, and memorizing the number of tokens distributed while the chip card is not inserted into the chip card payment mechanism.

10. A method of receiving payment and discharging winnings at a games machine, the method comprising the steps of:

accepting payment in the form of tokens with a token payment mechanism, including the step of transmitting a signal from the token payment mechanism which indicates that payment in the form of tokens has been accepted;

discharging winnings in the form of tokens with a token discharge mechanism, including the step of receiving a signal at the token discharge mechanism which instructs the token discharge mechanism to discharge tokens;

automatically switching between (1) the token payment mechanism and the token discharge mechanism and (2) a chip card payment mechanism wherever a chip card is inserted into the chip card payment mechanism, accepting payment only in the form of chip card debits with the chip card payment mechanism for so long as a chip card is inserted in the chip card payment mechanism, including the step of transmitting a signal from the chip card payment mechanism which indicates that payment in the form of chip card debits has been accepted;

discharging winnings in the form of chip card credits with the chip card payment mechanism, including the step of receiving a signal at the chip card payment mechanism which instructs the chip card payment mechanism to discharge chip card credits to the chip card; and emulating (1) the token payment mechanism and the token discharge mechanism with (2) the chip card payment mechanism, the emulating step including the steps of ensuring that the signal transmitted from the chip card payment mechanism during the chip card payment accepting step has the same format as the signal transmitted from the token payment mechanism during the token payment accepting step, and ensuring that the signal received at the chip card payment mechanism during the chip card winnings discharging step has the same format as the signal received at the token discharge mechanism during the token winnings discharging step.

11. A method according to claim 10, wherein the automatically switching step further includes the step of ascertaining whether a chip card has been inserted into the chip card payment mechanism, and if the chip card has been inserted into the chip card payment mechanism, then accepting payment only from the chip card;

and if the chip card has not been inserted into the chip card payment mechanism, then accepting payment only from tokens;

and wherein the ascertaining step is performed by the games machine.

12. A method according to claim 10, wherein during the ascertaining step the games machine ascertains that the chip card has not been inserted into the chip card payment mechanism, and further comprising the steps of inserting a token into the token payment mechanism;

holding the token in a position adjacent a token recognition device;

interrogating the token while the token is held adjacent the token recognition device.

13. A method according to claim 10, wherein during the ascertaining step the games machine ascertains that the chip card has not been inserted into the chip card payment mechanism, and further comprising the steps of counting a number of tokens distributed by a feeder box of the games machine, and memorizing the number of tokens distributed while the chip card is not inserted into the chip card payment mechanism.

* * * * *